US007497516B2

(12) United States Patent
Wullum

(10) Patent No.: US 7,497,516 B2
(45) Date of Patent: Mar. 3, 2009

(54) MOBILE JOINT WITH SEVERAL STABLE POSITIONS, SUITABLE FOR USE IN FURNITURE

(75) Inventor: Ole Petter Wullum, Trondheim (NO)

(73) Assignee: Varier Furniture AS, Skodje (NO)

( * ) Notice: Subject to any disclaimer, the term of this patent is extended or adjusted under 35 U.S.C. 154(b) by 184 days.

(21) Appl. No.: 10/500,906

(22) PCT Filed: Jan. 6, 2003

(86) PCT No.: PCT/NO03/00001

§ 371 (c)(1),
(2), (4) Date: Jul. 2, 2004

(87) PCT Pub. No.: WO03/055357

PCT Pub. Date: Jul. 10, 2003

(65) Prior Publication Data

US 2005/0116519 A1 Jun. 2, 2005

(30) Foreign Application Priority Data

Jan. 4, 2002 (NO) ..... 20020045

(51) Int. Cl.
*A47C 1/024* (2006.01)
*A47C 3/026* (2006.01)

(52) U.S. Cl. ..... 297/302.4; 297/300.1; 297/300.4; 297/300.5; 297/302.1; 297/302.3; 297/314; 297/325

(58) Field of Classification Search ..... 297/313, 297/314, 300.1, 302.1, 325, 326, 302.3, 302.4, 297/300.4, 300.5
See application file for complete search history.

(56) References Cited

U.S. PATENT DOCUMENTS

| | | | | |
|---|---|---|---|---|
| 2,932,341 | A * | 4/1960 | Morrison et al. | 297/314 X |
| 2,949,153 | A * | 8/1960 | Hickman | 297/314 X |
| 3,599,232 | A * | 8/1971 | Tabor | 248/567 |
| 3,964,596 | A | 6/1976 | Heusler et al. | |
| 4,034,948 | A * | 7/1977 | Brownell | 248/585 |
| 4,645,059 | A | 2/1987 | Hofling et al. | |
| 4,909,472 | A * | 3/1990 | Piretti | 297/302.4 X |

(Continued)

FOREIGN PATENT DOCUMENTS

DE 3828914 A1 3/1990

(Continued)

OTHER PUBLICATIONS

International Search Report for PCT/FI2005/000007 Mailed Aug. 26, 2005.

*Primary Examiner*—Rodney B. White
(74) *Attorney, Agent, or Firm*—Kolisch Hartwell, PC

(57) ABSTRACT

The present invention relates to a mobile joint (1) for a seating construction, especially a chair, for mounting between a seat device and a base, comprising at least two joint elements (10, 30) which are reciprocally restricted pivoted between two extreme positions to allow tilting movement of the seating construction effected by the users weight displacement, comprising two outer joint elements (10, 30) which are pivoted related with a middle joint element (20), wherein the rotational axis (40, 50) between the two joint elements (10, 30) and the middle joint element (20) is displaced in relation to each other in the horizontal direction, whereby the joint (1) may assume a stable tilting position between the two extreme positions.

10 Claims, 13 Drawing Sheets

U.S. PATENT DOCUMENTS

| | | | | |
|---|---|---|---|---|
| 5,080,435 | A | 1/1992 | Desanta | |
| 5,150,948 | A | 9/1992 | Volke | |
| 5,209,548 | A * | 5/1993 | Locher | 297/300.4 |
| 5,417,437 | A | 5/1995 | Coppard et al. | |
| 5,918,722 | A | 7/1999 | Behle | |
| 6,085,891 | A | 7/2000 | Behle | |

FOREIGN PATENT DOCUMENTS

| | | | |
|---|---|---|---|
| DE | 9315150 | U1 | 2/1995 |
| EP | 0 169 349 | | 1/1986 |
| EP | 0 490 591 | A2 | 6/1992 |
| EP | 0 606 990 | A1 | 7/1994 |
| EP | 0 795 512 | A1 | 9/1997 |
| NO | 166518 | | 4/1991 |
| NO | 175961 | | 3/1994 |
| NO | 179192 | | 5/1996 |
| WO | WO 2005/042388 | A2 | 5/2005 |

* cited by examiner

MOBILE JOINT WITH SEVERAL STABLE POSITIONS, SUITABLE FOR USE IN FURNITURE

BACKGROUND OF THE INVENTION

The present invention relates to a mobile joint with several stable positions suitable for use in furniture such as a chair, and especially a reclining chair.

PRIOR ART

Several types of mobile joints between the seat and base of chairs are known from prior art, especially in office chairs. However, these chairs usually only have two extreme stable positions, such as a sitting position and a relaxing position. In order to use these chairs between the extreme positions, the joint must usually be locked, typically by means of a handle or similar device. Such handles are usually difficult to find or reach, as they should preferably not be conspicuous in relation to the appearance of the chair. When such handles are more accessible, they easily get in the way of the user and are more subject to wear and breakage.

Further, there exist several different recliners with reclining backrest. In these chairs, the chair back may often be reclined by leaning backwards, and pivoting joints or rails are used in different embodiments to enable movement. In order to provide resistance against this movement, friction elements or springs for example are used. It is also common in this type of chair that the friction elements may be locked, or that other locking mechanisms may be used in order to lock the chair in a chosen position. In some chairs, the seat is also moved as a function of the movement of the back, such as forward and slightly upwards. A disadvantage of these chairs is that force must be used to move the back of the chair and/or to lock the back in an intermediate position.

There are also chairs which may move between several stable positions by the use of runners, approximate to a rocking chair, but which also consists of straight segments that are positioned at an angle in relation to each other. The user may thereby move the chair between fixed positions by changing his centre of gravity in relation to the segments. The problem with this solution is that the runners become large and bulky, and that it is possible to trap ones foot under the runners for example. Furthermore, it is difficult to dampen the movements, and the chair will not go back to any particular initial position.

In order to obtain a good resting position and good blood circulation, it has proven advantageous to rest ones feet in a relatively high position, such as at the height of the heart. This possibility is limited in the aforementioned chairs.

There exists therefore a need for a joint for chairs, wherein a chair seat with backrest may be tilted to more than two stable positions in relation to the support, in a simple manner, without the need for using handles or other operating devices. The joint should additionally be compact and robust, and be adjustable to the user, and should preferably return to an initial position when the chair is not in use.

BRIEF DESCRIPTIONS OF THE INVENTION

The object of the present invention is to provide a joint for a chair that solves the above problems and satisfies the shortcomings of earlier solutions.

The object is achieved by a mobile joint, as defined in the patent claims, comprising a mobile joint for a seating construction, especially a chair, for installation between a seat part of the seating construction and a support for the same, comprising at least two joint elements which are reciprocally limited pivoted between two extreme positions to allow a tilting movement of the seating construction effected by the users weight displacement, characterised in that it comprises two outer joint elements that are pivoted connected to a middle joint element, wherein the pivoted axles between the two outer joint elements and the middle joint element is displaced in relation to each other in the horizontal direction, whereby the joint may assume a stable pivotal position between the two extreme positions.

DETAILED DESCRIPTION

The invention will now be described in more detail by the examples of embodiments below, in association with the figures mentioned above. The examples are meant to give a better understanding of the invention and thus do not limit its scope.

In the following description the terms "foremost" and "forward" are used for the direction the user looks towards, when he or she is sitting with their back against the back of the chair in a normal way, and the terms "rear" and "backward" regard the opposite direction, unless specifically indicated to the contrary.

Further, references to the angle of the joint should be understood as the angle between the sitting area of the chair and the support, for example the floor. In the indicated embodiments, this corresponds to the angle between the upper and lower area of the described joint, but this is not necessarily the case in other embodiments of the joint.

EXAMPLE A

Figure 1:
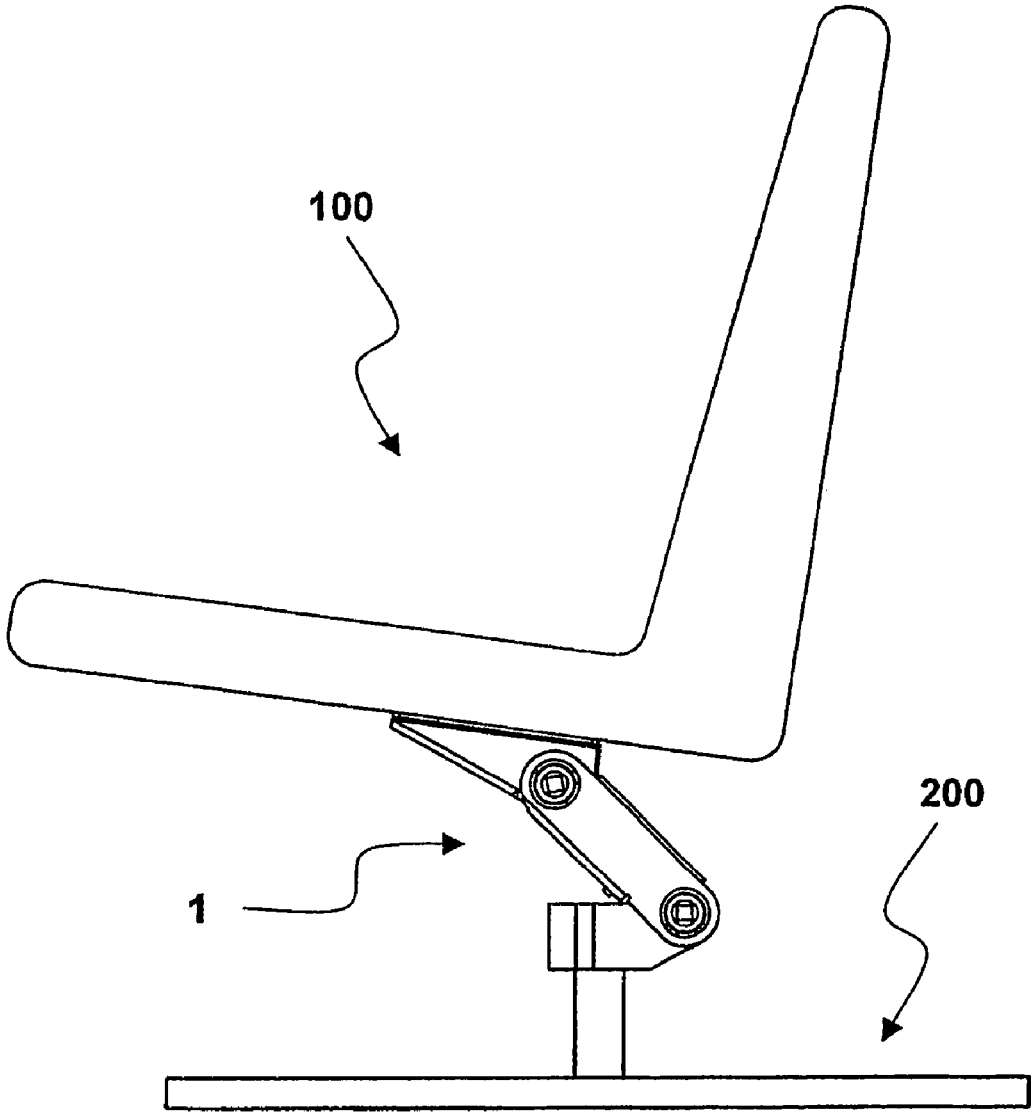
FIG. 1 shows a profile of a joint according to the invention used between the base and seat of a chair.

As shown in FIG. 1, the joint 1 according to the invention is suited as a binding joint between chair seat 100 and a base 200. The base 200 often consists of a vertical base rod, which may perhaps be pivoted/rotational, and a mainly horizontal base foot with a dimension that should prevent the chair from tipping over when the base is not fixed to the support.

Figure 2:
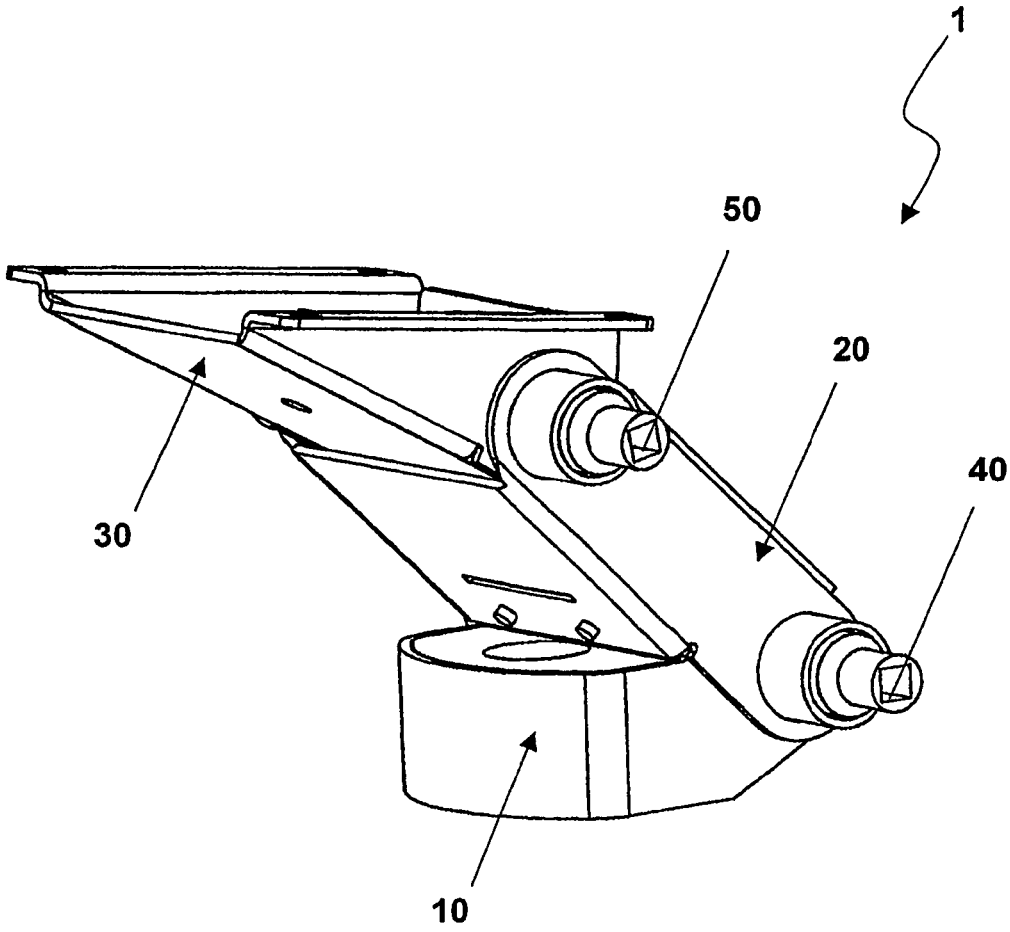
FIG. 2 shows a perspective view of the joint in FIG. 1.

In this embodiment the joint 1 is assembled as shown in FIG. 2, namely by three joint elements 10, 20 and 30 which are joined by pivoted axles 40 and 50. Each joint element may be pivoted between two extreme positions in relation to each joint element that it is connected to.

When the joint 1 constitutes a joint between a seat of a chair 100 and a base 200 as in FIG. 1, or another solid element, the joint elements will be designated as "lower joint element" 10, "middle joint element" 20 and "upper joint element" 30.

In this embodiment the lower joint element 10 is principally parallel to the support and perpendicular to the base rod. The lower joint element 10 will be arranged with the base 200 and is joined to the lower end of the middle joint element 20 via a horizontal pivoted axle 40. The middle joint element 20 is further joined in its upper end to the upper joint element 30 via a horizontal axle 50 which is arranged in parallel with the axle 40. The upper joint element 30 will be arranged with the seat of the chair, and is principally in parallel with the sitting area of the chair seat. The upper area of the upper joint element 30 is thus suited as a fastening surface for the chair seat underside.

The joint 1 may assume three stable positions depending on the users placement of their centre of gravity in relation to the axles 20 and 40, in that the joint elements 10, 20, 30 cooperate as mentioned above.

Figure 3:
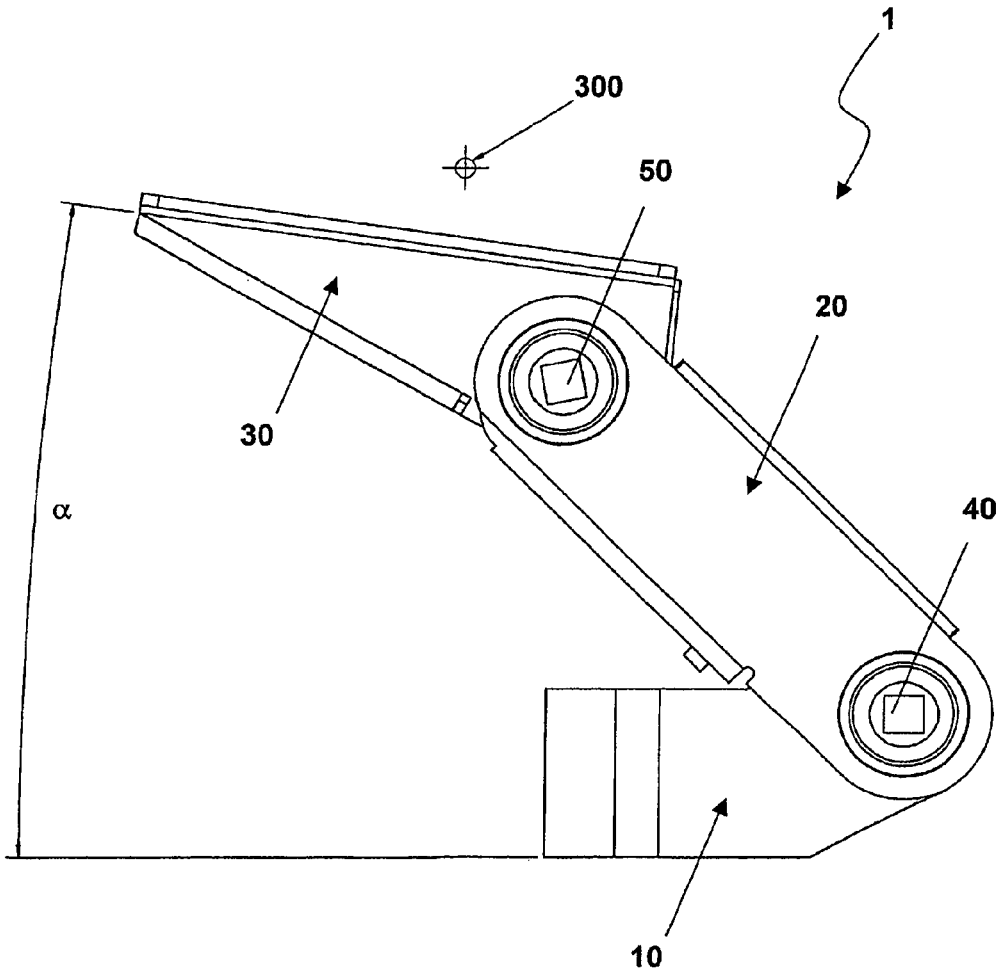
FIG. 3 shows the joint in FIG. 1 in one position.

In FIG. 3 the joint 1 is shown in an initial position wherein the user's centre of gravity 300 is localised in front of both axles 40 and 50. The joint 1 then has an angle $\alpha$ (between the upper area 31 of the joint and the support, see FIG. 6), which may be any angle which is suitable for the intended use, and in this case is for example about 8°, when the chair is to be used for sitting up straight.

Figure 4:
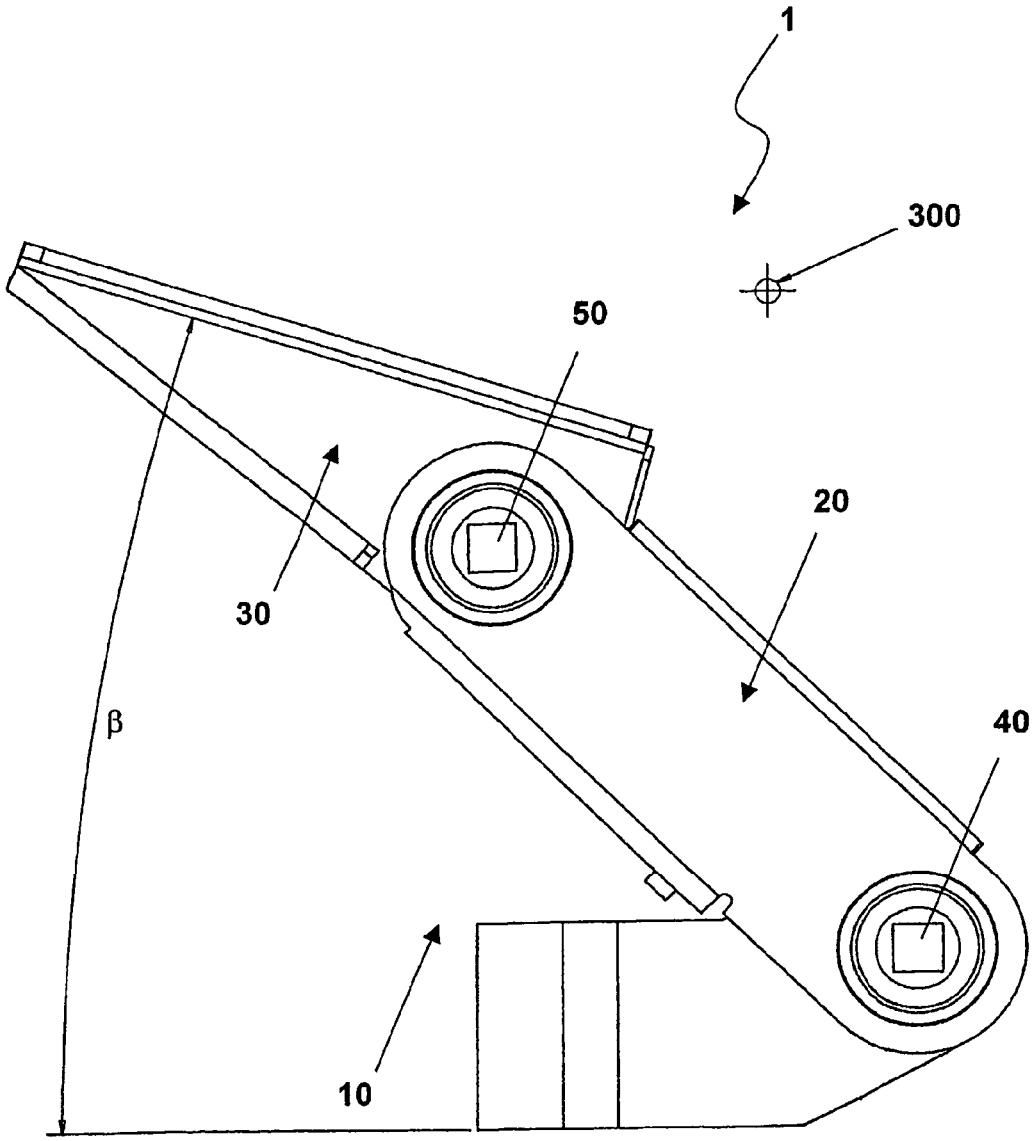
FIG. 4 shows the joint in FIG. 1 in an alternative position.

In FIG. 4 the joint is shown in an intermediate position, wherein the user's centre of gravity 300 is placed between the two axles 40 and 50. The joint 1 then has an angle $\beta$, which in this case is larger than $\alpha$, for example about 18°.

Figure 5:
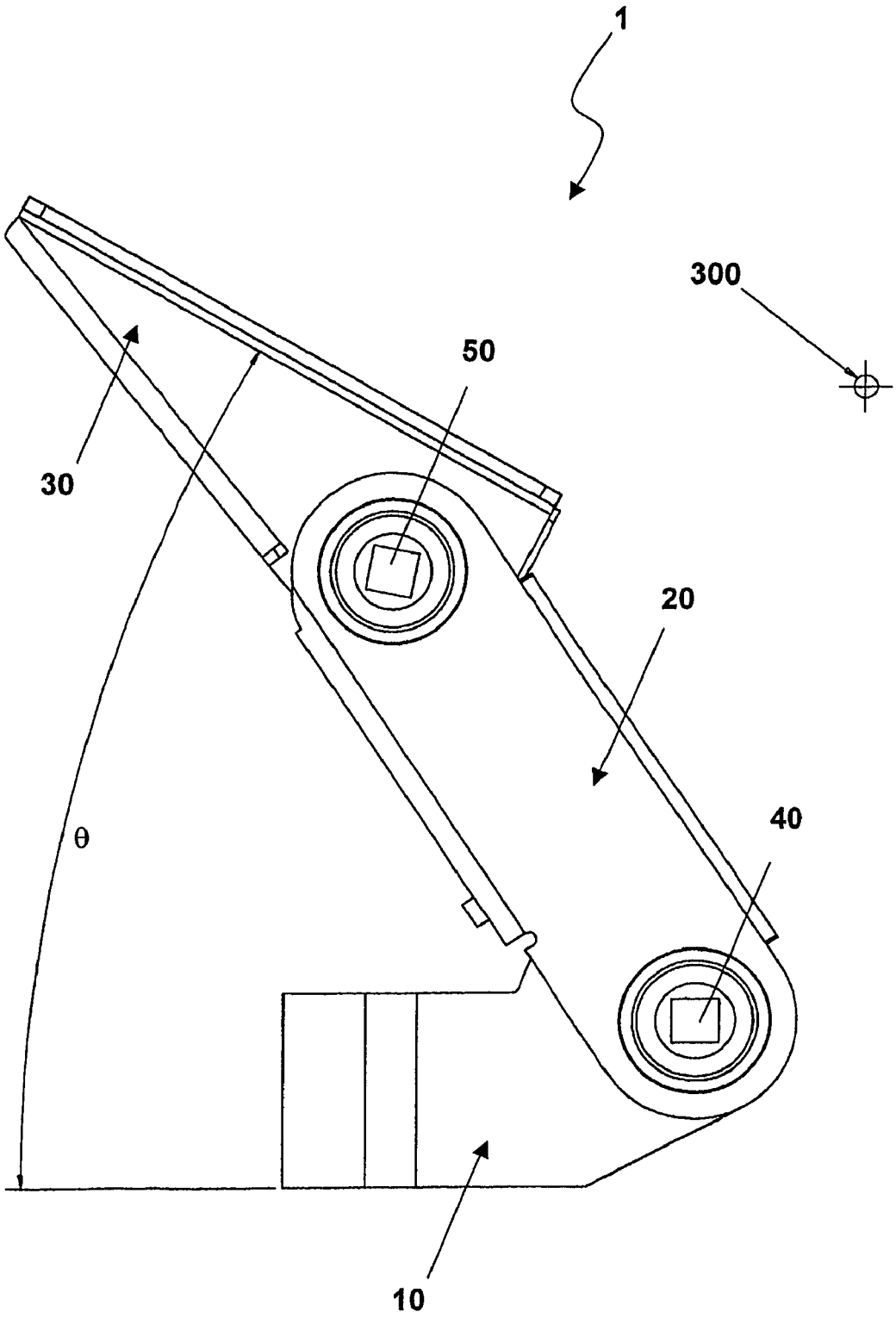
FIG. 5 shows the joint in FIG. 1 in an alternative position.

In FIG. 5 the joint is shown in an extreme position wherein the user's centre of gravity 300 is placed behind both the axles 40 and 50. The joint then has an angle $\theta$, which in this case is larger than both $\alpha$ and $\beta$, for example about 30°.

The joint 1 is preferably spring-loaded, but this is not necessary. The spring-loading may strain the joint 1 forward towards its initial position such that the chair will return to this position when it is not strained by the user. Furthermore, the spring-loading will dampen the motions of joint 1 and provide smooth transition between the aforementioned stable positions. This leads to comfortable movement and better security against sudden movements by the user who may tip the chair over. The spring-loading may generally be adapted to aspects such as the user's weight, the weight of the chair seat, the angle between the sitting area and the back of the chair, as well as the mounting position of the chair seat in relation to the joint.

The spring-loading of the axles 40 and 50 is in this embodiment provided by torsion springs and are equipped with the option of adjusting the springs, which may be tightened or loosened to accommodate more precisely to the user's weight.

Figure 6:
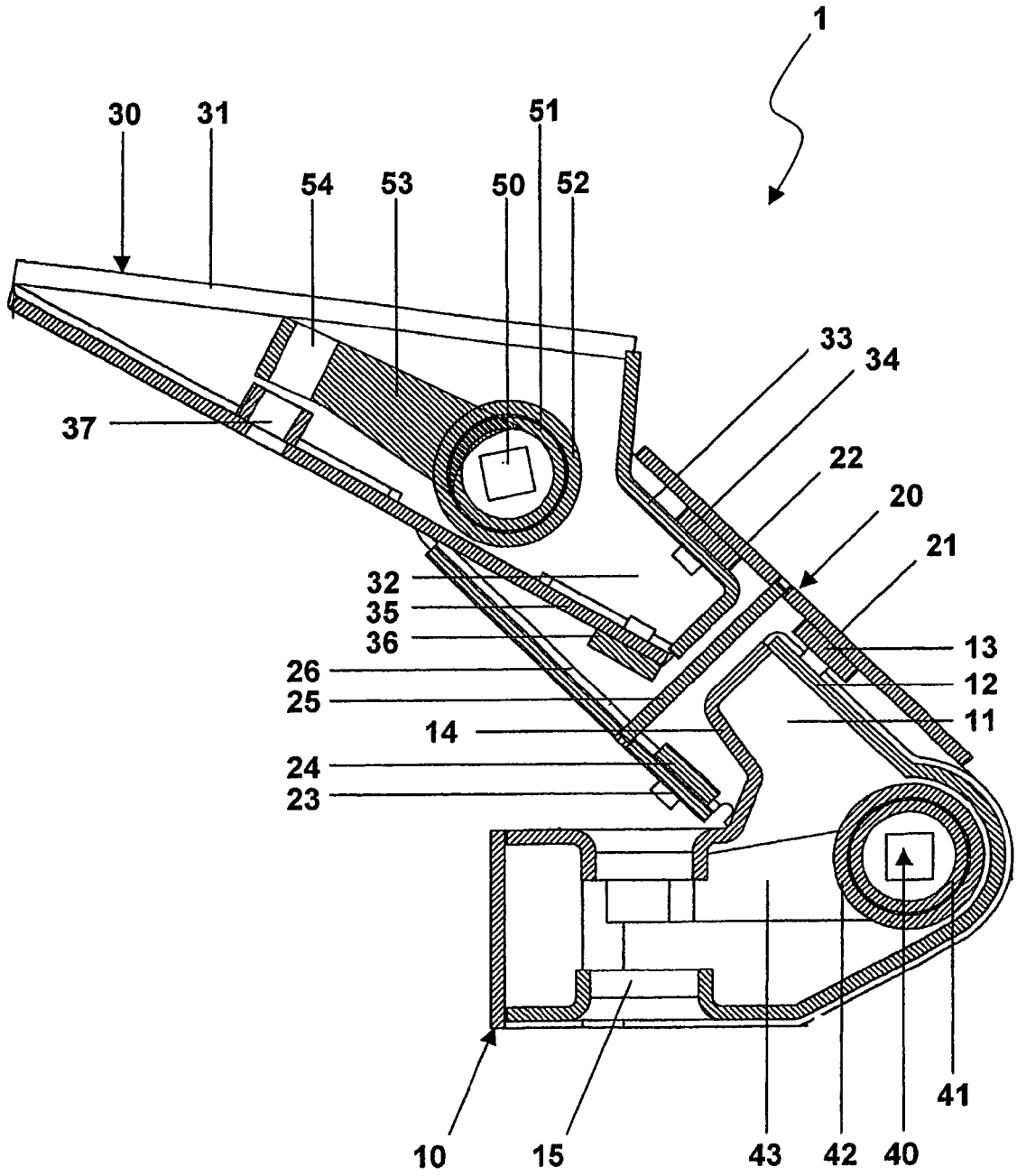
FIG. 6 shows a section from the side of the joint in FIG. 2.

In order to achieve the aforementioned cooperation between joint elements 10, 20 and 30, reference is made to FIG. 6, wherein the fitting surface of the joint elements and blocking elements are shown.

In FIG. 6 the joint 1 is in the initial position as shown in FIG. 3. In this embodiment the joint elements are designed such that the outer joint elements 10 and 30 have blocking elements 11 and 32 respectively, projecting into the middle joint element 20.

The projecting blocking element 11 has an upper fitting surface 12, optionally equipped with a rotational stopper 13, abutting against a cooperating upper fitting surface 21 on the inner wall of the middle joint element 20, which hinders the middle joint element 20 from further movement forwards. Similarly, the projecting blocking element 32 has an upper fitting surface 33, optionally equipped with a rotational stopper 34, abutting against a corresponding fitting surface 22 on the inner wall of the middle joint element 20, hindering the upper joint element 30 in further movement forward.

The rotational stoppers serve to dampen the impact of the fitting surfaces on contact between these, and in reducing bothersome sound, and may for example be made of a polymer material. The rotational stoppers may be fastened to any of the corresponding fitting surfaces or both.

The lower joint element 10 may be equipped with parts for a connecting element, such as a guide 15, such that the joint 1 may optionally be fastened to a base. Similarly, the upper joint element 30 may be equipped with an upper surface 31 prepared for fastening to a chair seat, for example by fastening bolts and/or a track arrangement.

In this embodiment the axle 50 consists of an inner pivot element 51 and an outer pivot element 52, reciprocal connected by a torsion spring (not shown) in a manner that is known as such, fastened to the upper joint element 30 and the middle joint element 40 respectively, or vice versa. The spring-loading of axle 50 may optionally be adjusted by a torsion arm 53 adjusted by a screw device (not shown) through adapted openings 54 and 37 in the torsion arm 53 and the upper joint element 30 respectively. Similarly, the axle 40 consists of an inner pivot element 41 and an outer pivot element 42, reciprocal connected by a is torsion spring (not shown), fastened to the middle joint element 20 and the lower joint element 10 respectively, or vice versa. The spring-load of the axle 40 may optionally be adjusted by a torsion arm 43 that is adjusted accordingly as mentioned above.

The middle joint element 20 may optionally have a reinforcing inner wall 25 in order to attain sufficient rigidity and strength in the element.

Figure 7:
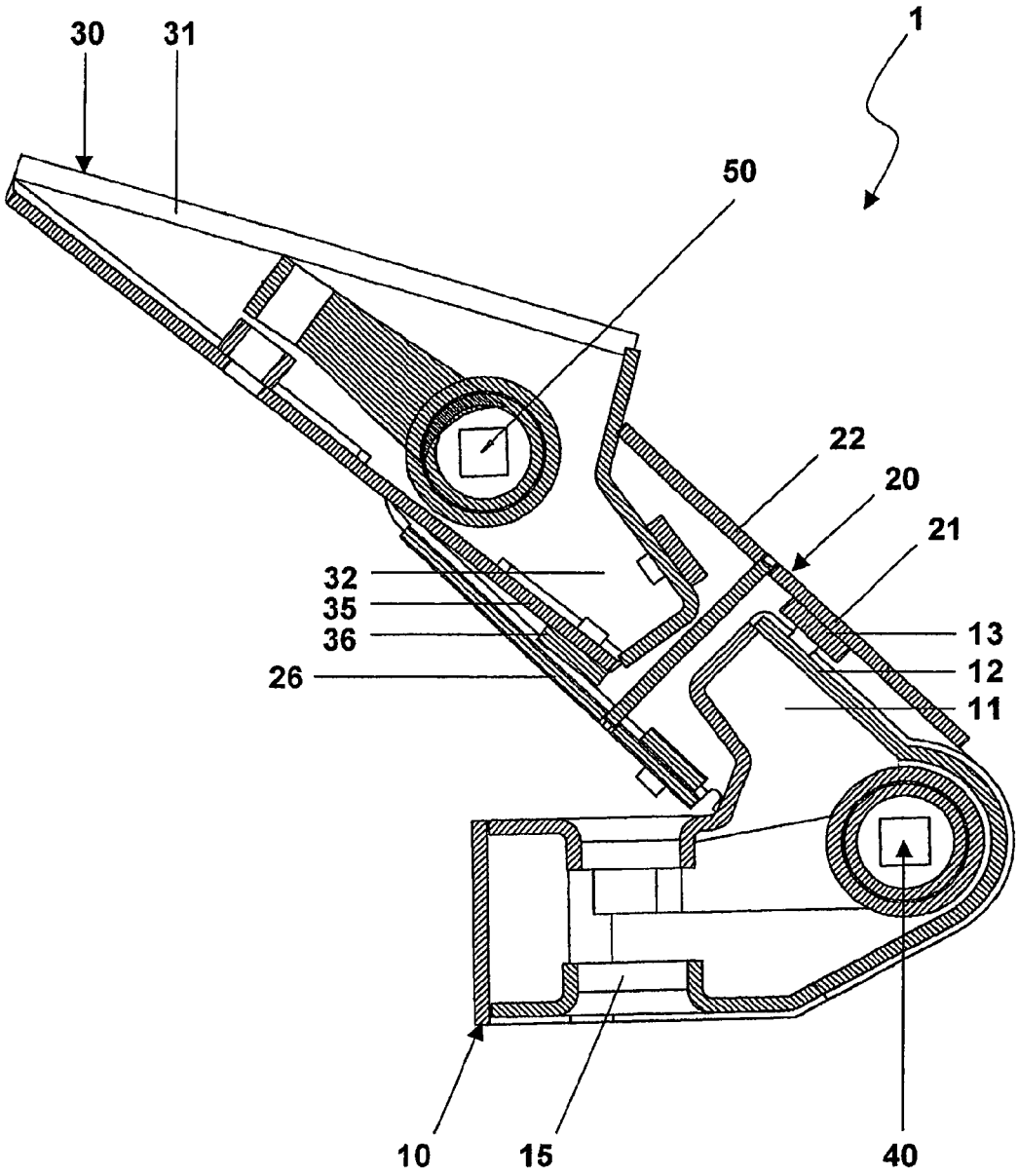
FIG. 7 shows a section from the side of the joint in FIG. 3.

In FIG. 7, the joint 1 is stably in an intermediate position. In this position, the lower joint element 10 and the middle joint element 20 have the same position in relation to each other, as in FIG. 4, since the user's centre of gravity has not passed the rear axle 40. On the other hand, the upper joint element 30 is tilted backwards, such that the protruding blocking element 32 with lower fitting surface 35, possibly equipped with a rotational stopper 36, abuts against a corresponding lower fitting surface 26 on the inner wall of the middle joint element 20, that hinders the upper joint element 30 from further movement backwards.

Figure 8:
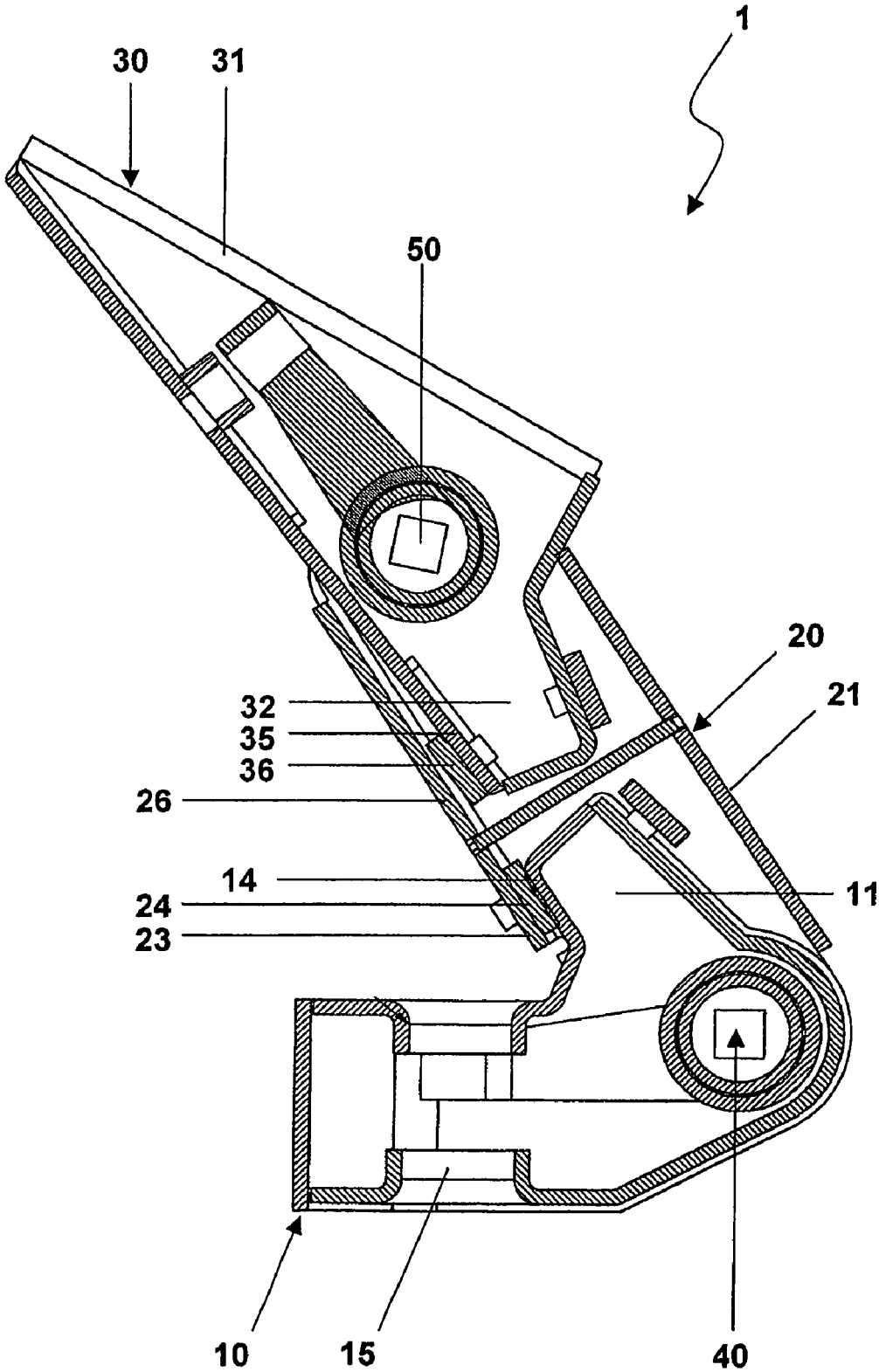
FIG. 8 shows a section from the side of the joint in FIG. 4.

In FIG. 8 the joint 1 is in an extreme position. In this position, the upper joint element 30 and the middle joint element 20 have the same position in relation to each other as in FIG. 5, as the user's centre of gravity still lies behind axle 50. However, the middle joint element 20 is tilted backward so that the protruding blocking element 11, with lower fitting surface 14, abuts against a corresponding lower fitting surface 23 on the inside of the middle joint element 20, possibly equipped with a rotational stopper 24, that hinders the middle joint element 20 from further movement backward.

EXAMPLE B

Figure 9:
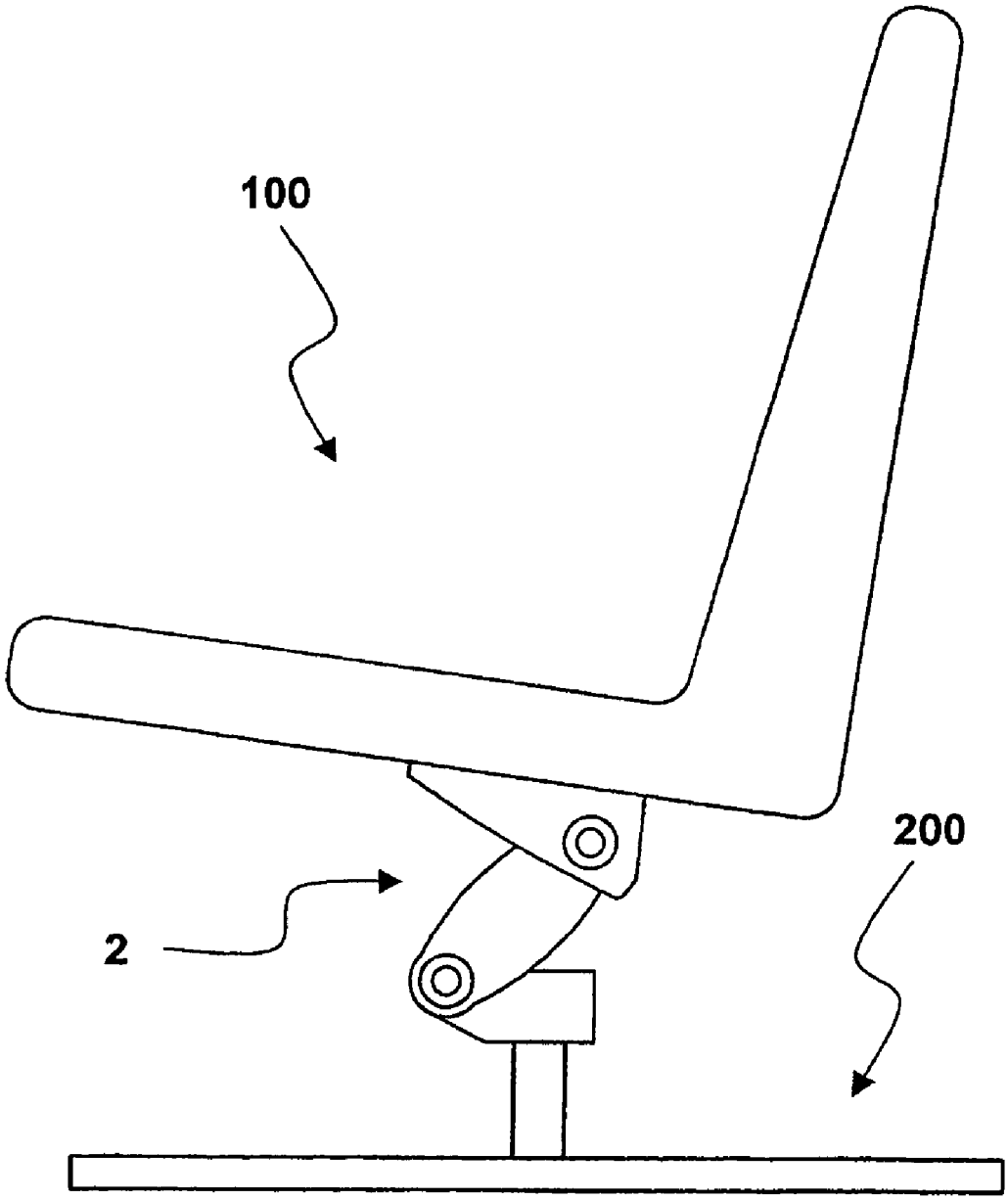
FIG. 9 shows a profile of an alternative embodiment of a joint according to the invention used between a chair base and seat.

FIG. 9 shows an alternative embodiment of a joint 2 according to the invention as a connecting joint between a chair seat 100 and a base 200. The joint 2 functions according to the same principles as the joint 1 described above, but the joint elements will move in different sequence than in the joint 1 described earlier.

Figure 10:
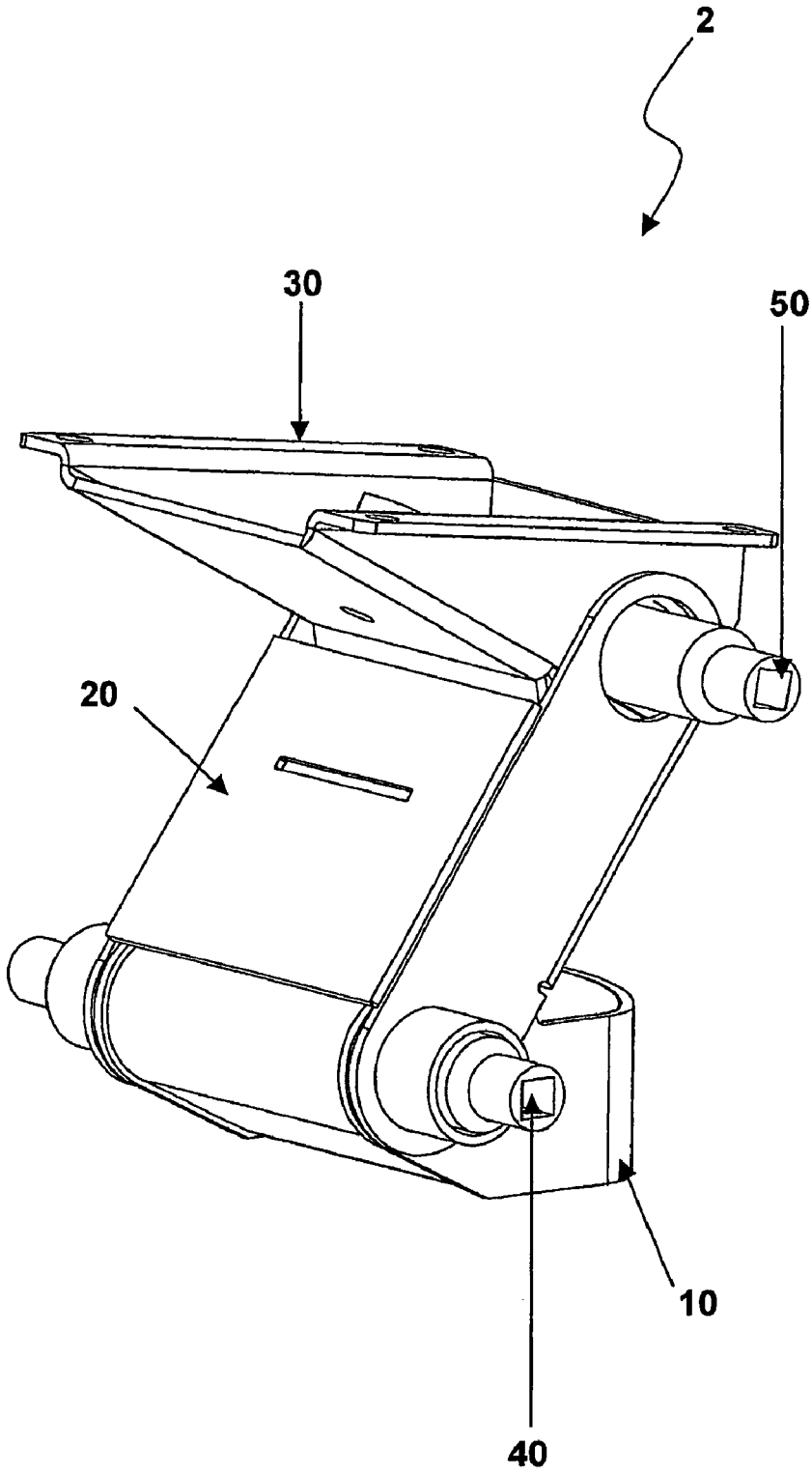
FIG. 10 shows a perspective view of the joint in FIG. 8.

As may be seen from FIGS. 9 and 10, the joint 2 has a Z-form making it very compact in that the joint elements 10, 20, and 30 lie mainly directly above each other in the vertical direction. Thus, this joint 2 has a narrower tilt-range in the horizontal plane when mounted on a revolving base, than the aforementioned joint 1.

Figure 11:
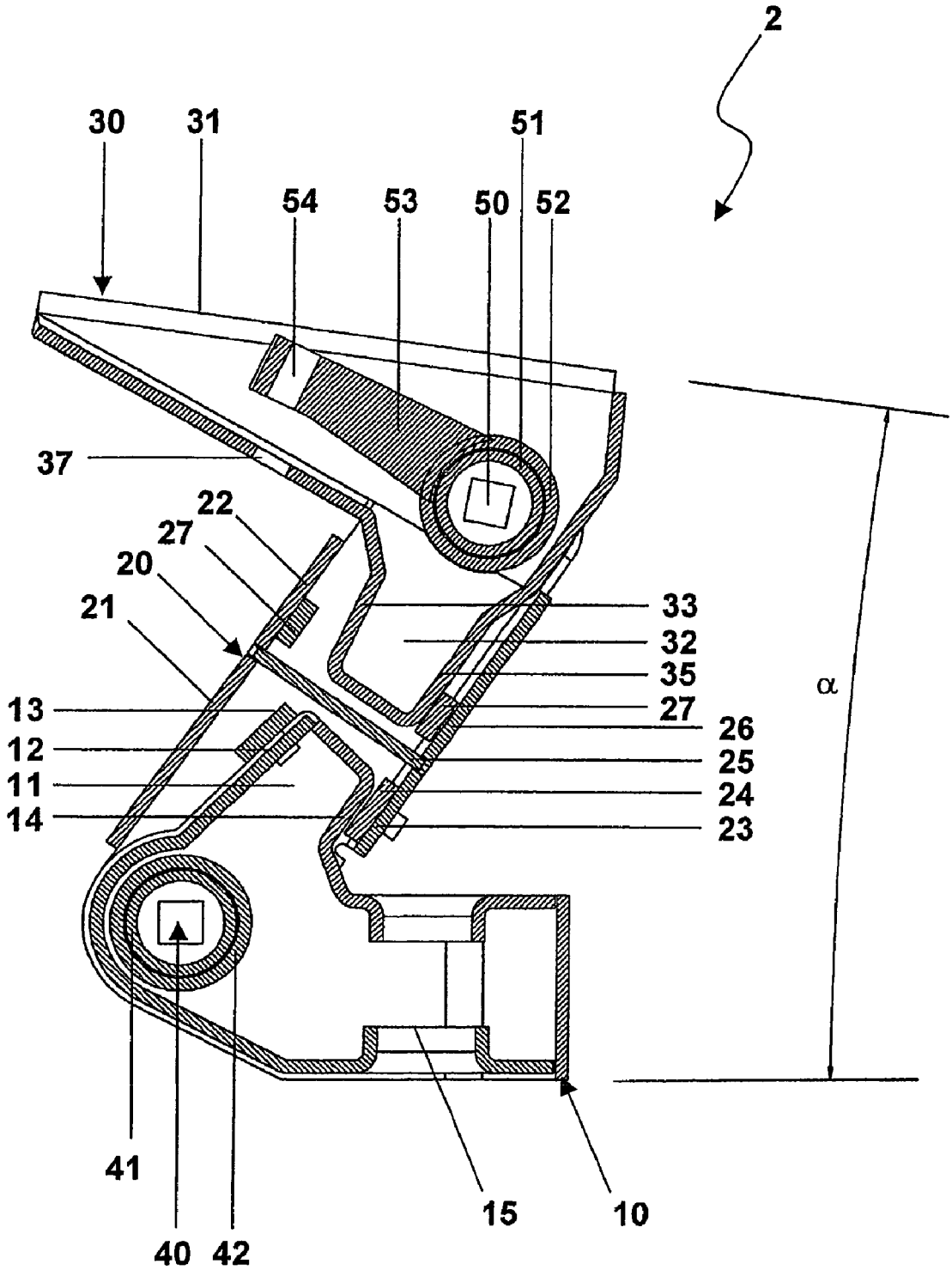
FIG. 11 shows a section from the side of the joint in FIG. 8 in one position.

In FIG. 11, the joint 2 is in an initial position corresponding to the joint 1 in FIGS. 3 and 6. The joint 2 then has an angle α, for example about 8°. In this embodiment, the middle joint element 20 is restricted from further movement forward in that its protruding blocking element 11, lower fitting surface 14, which abuts against corresponding lower fitting surface 23 on the inner wall of the middle joint element 20, which is possibly equipped with a rotational stopper 24. Furthermore, the upper joint element 30 is restricted from further movement forward by its protruding blocking element 32 with lower fitting surface 35 which abuts against a corresponding lower fitting surface 26 on the inner wall of the middle joint element 20, which possibly is equipped with a rotational stopper 26.

Figure 12:
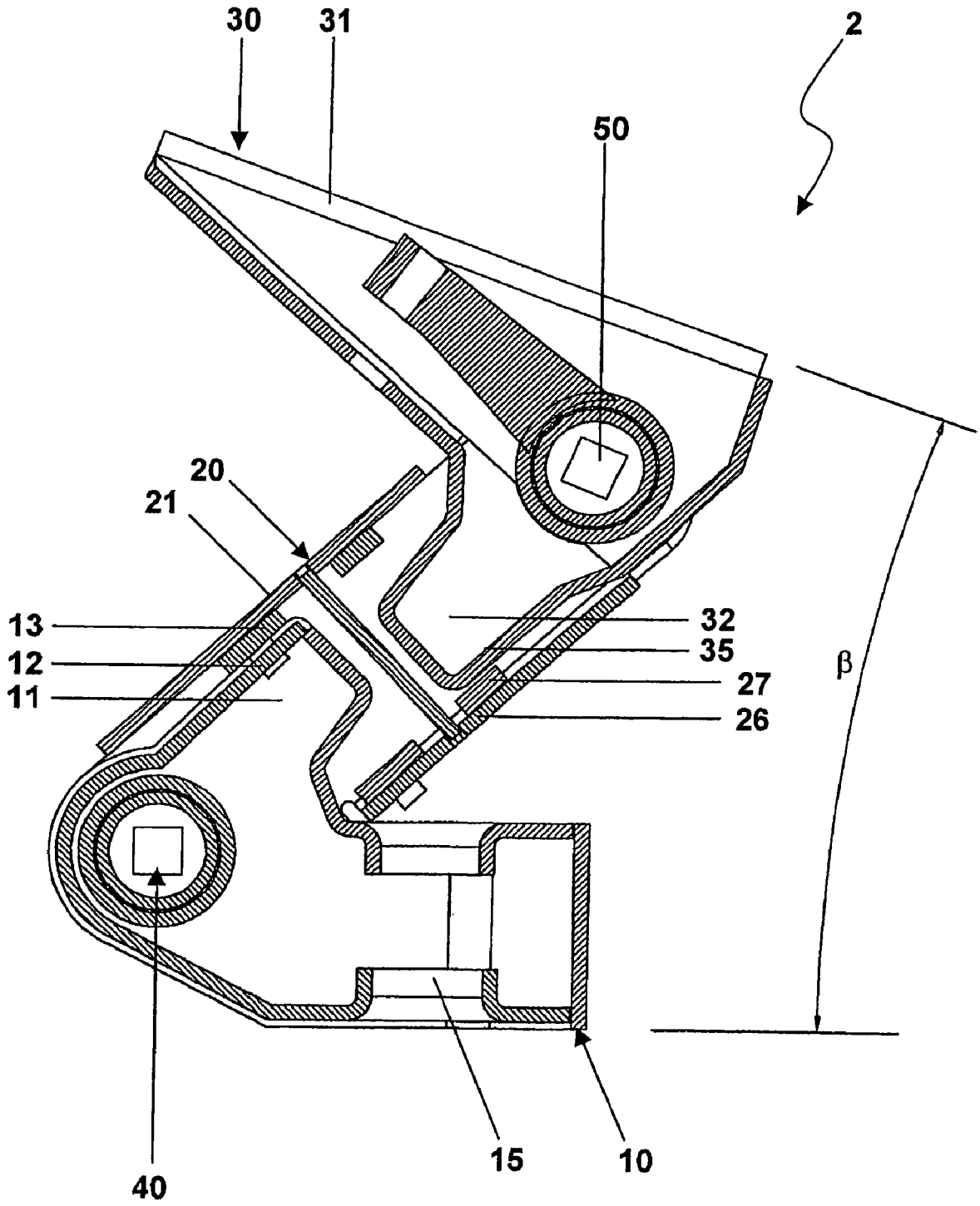
FIG. 12 shows the joint in FIG. 10 in an alternative position.

In FIG. 12 the joint 2 is in an intermediate position, corresponding to the joint 1 in FIGS. 4 and 7. The joint 2 then has an angle β which in this case is greater than α, for example about 18°. In this position, the upper joint element 30 and the middle joint element 20 have the same position in relation to each other as in FIG. 11, as the user's centre of gravity has not exceeded the axle 50, which now lies behind axle 40, in contrast to example A. On the contrary, the middle joint element 20 is tilted backwards and thus hindered from further movement backwards by the protruding blocking element 11 with upper fitting surface 12, possibly equipped with a rotational stopper 13, abutting against corresponding upper fitting surface 21 on the inner wall of the middle joint element 20.

Figure 13:
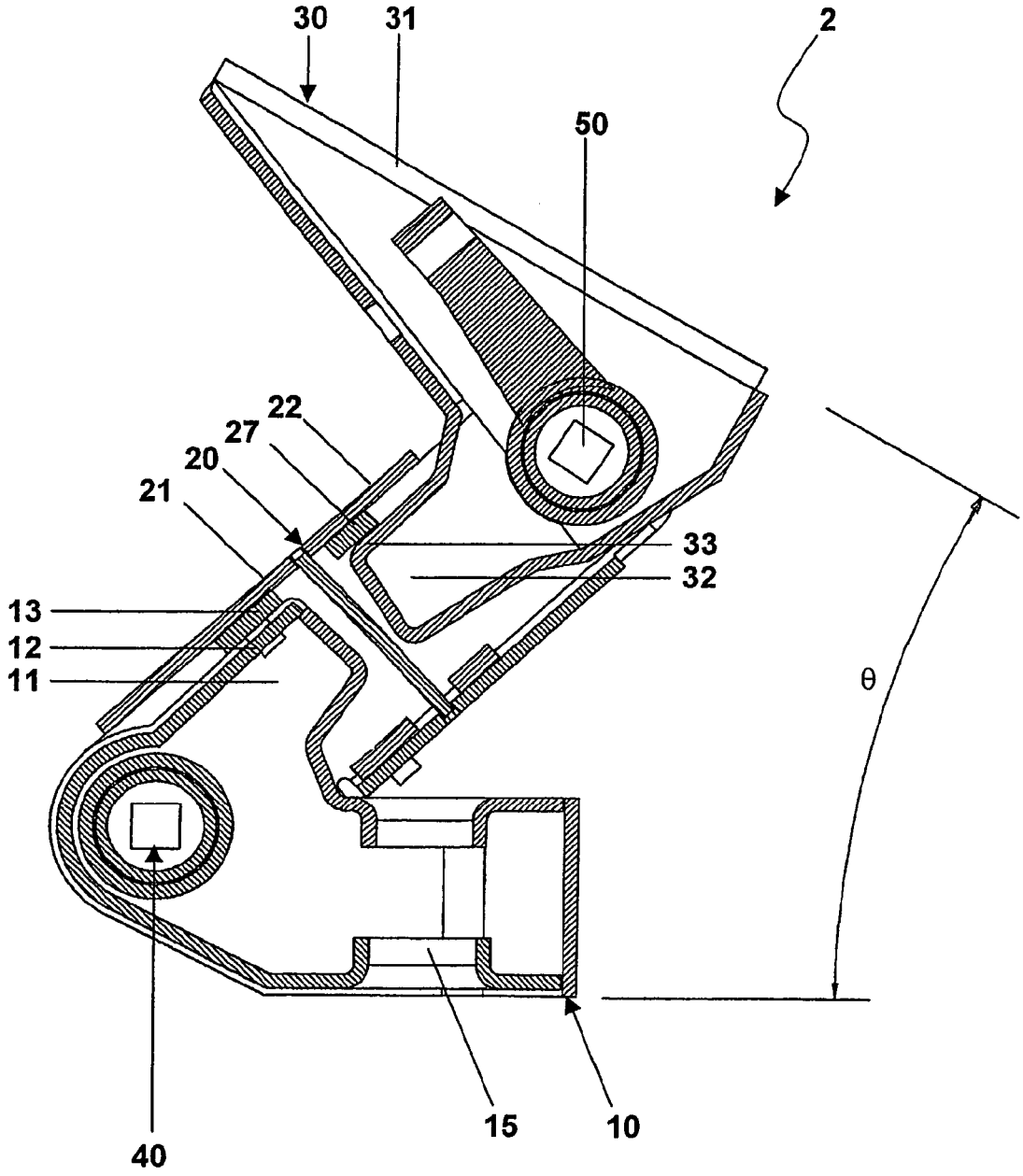
FIG. 13 shows the joint in FIG. 10 in an alternative position.

In FIG. 13 the joint 1 is in an extreme position, corresponding to the joint 1 in FIGS. 5 and 8. The joint then has an angle θ which in this case is larger than α and β, for example about 30°. In this position the lower joint element 10 and the middle joint element 20 are in the same position in relation to each other, as in the previous FIG. 12, as the user's centre of gravity still lies behind axle 40. The upper joint element 30 is on the other hand tilted backwards and hindered from further movement backwards by the protruding blocking element 32 with upper fitting surface 33 abutting against the corresponding upper fitting surface 22 on the inside of the middle joint element 20, which possibly is equipped with a rotational stopper 27.

In the above mentioned examples A and B the distance and angle relationship between the axles 40 and 50 are important in order to attain the intended effect of the joint. The most favourable version of the joint is dependant on factors such as the design of the chair seat, the angle of the back and the weight of the seat, as well as the weight of the user, and possibly restrictions due to the design of the base. Furthermore, the angle and distance factors are influenced by possible spring-loading and the hardness of the spring. In the aforementioned example B, the dimensions of the joints are for example typically about 20×15×15 cm (height×length×width) in an initial position, thereby constituting a very compact joint. Furthermore, the distance between the axles (40, 50) is for example typically about 12 cm, with an angle of about 60° between a line through the axles 40 and 50 and a horizontal plane in an initial position. The horizontal distance between the axles (40, 50) may for example be about 6-10 cm, but may vary widely in relation to the design. The joint may be produced in any suitable material such as a metal, a plastic material or a composite material, preferably a metal such as steel or aluminium.

ALTERNATIVE EMBODIMENTS

In the above mentioned embodiments A and B, the joint elements are constructed such that the outer joint elements 10 and 30 have blocking elements 11 and 32 respectively, which extend into the middle joint element 20, but the opposite is of course also possible. The middle element 20 may thus be equipped with one or more blocking elements which either extends into one or both outer joint elements 10 and 30, with corresponding fitting surfaces on the inner walls. A blocking element may further consist of several extending blocking elements cooperating with corresponding structures in the opposite joint, something that may provide more fitting surfaces and enable a larger contact area.

In an alternative embodiment, the joint 1 and 2 may have more joint elements and axles in order to have several intermediate stable positions. Furthermore, the stable positions may be adapted to the intended use. In this situation, the spring-loading in one or more of the axles may be reversed in order to attain other initial positions or effects, for example.

In an alternative, the initial position may for example be the intermediate position described earlier, so that the joint may tilt forwards or backwards according to the user's desire, which may be useful in an office chair. In this respect, the allowed backward deflection angle may be greater than forward, and a possible spring-loading may be tighter forward than backward, or vice versa.

In another alternative, the function of the joint may be to enable tilting of the chair forwards in two or more stable positions, such as in an office chair. The seat of the chair 100 may then for example be mounted to the joint 1 or 2 in the opposite direction of that which has been described earlier.

Further, the joint of the present invention may be used to obtain tilting of furniture in direction other than forwards or backwards, such as to the side or a combination thereof, in order to adapt to the possibilities of the use of the furniture. This may for example be obtained in that the joint may contain non-parallel axles, or by using two or more joints rotated in relation to each other in the horizontal plane.

Further, the joint according to the invention may be used together with any seat of the chair or furniture with any design. Such a chair may also be a chair without a back of the chair, such as a stool, or a chair wherein the user has a sitting position which is supported both at the knees and the behind.

The spring-load may possibly be obtained by other spring types than torsion springs, such as for example a coil spring, plate spring or other elastic material.

The spring-loading of the rotational axis (40, 50) is, as mentioned, not necessary but gains greater importance if the horizontal distance between the rotational axis (40, 50) is small. In an alternative embodiment, the rotational axis (40, 50) may be positioned horizontally above each other, and a difference in spring load of the two rotational axis (40, 50) will then make a stable intermediate tilting position possible.

The invention claimed is:

1. A mobile joint (1) for a seating construction for mounting between a seat device (100) of a seating construction and a support (200) for said seat device (100), comprising at least two joint elements (10, 30) wherein each joint element is pivotable to a limited degree in relation to each joint element that it is connected to, permitting the mobile joint (1) to pivot between two extreme positions in order to allow a tilting movement of the seat device (100), effected by the user's weight displacement, wherein the mobile joint contains a first joint element (10) mountable at a first end to the support (200) and at a second end only mounted pivotally to a first end of a middle joint element (20) at a first rotational axis (40), and further containing a second joint element (30) mountable at a first end to the seat device (100) and at the second end only mounted pivotally to a second end of the middle joint element (20) in a second rotational axis (50), wherein the said rotational axes (40, 50) are horizontally displaced in relation to each other, and whereby the joint (1) assumes a stable tilting position between the two extreme positions when the user's center of gravity is above a point between the first and second rotational axes;

wherein at least two of the joint elements (10, 20, 30) are spring-loaded in relation to each other by a torsion spring.

2. The mobile joint (1) of claim 1, wherein the middle joint element (20) consists of a number of joint sub-elements, wherein the mobile joint (1) is configured to assume a number of additional stable tilting positions between the two extreme positions.

3. The mobile joint (1) of claim 1, wherein the horizontal distance between the rotational axes (40, 50) is about 5-15 cm.

4. The mobile joint (1) of claim 3, wherein the horizontal distance between the rotational axes (40, 50) is about 6-10 cm.

5. The mobile joint (1) of claim 1, wherein the tilted positions of each joint element are restricted by pairs of reciprocally cooperating fitting surfaces (12, 21; 14, 23; 33, 22; 35, 26), where each pair of reciprocally cooperating fitting surfaces is configured to abut when a joint element is pivoted to a desired point, thereby hindering further movement of the joint element.

6. The mobile joint (1) of claim 5, wherein one or both members of at least one pair of cooperating fitting surfaces (12, 21; 14, 23; 33, 22; 35, 26) is equipped with a stopper (13, 24, 34, 36), wherein the stopper is configured to dampen the impact between the pair of cooperating fitting surfaces when the corresponding joint element is pivoted to the desired point.

7. The mobile joint (1) of claim 1, wherein the spring load is adjustable.

8. The mobile joint (1) of claim 1, wherein the first and second joint elements (10, 30) have different spring-loads in relation to the middle joint element.

9. The mobile joint (1) of claim 1, wherein at least two joint elements (10, 20, 30) are lockable in relation to each other.

10. A chair comprising a mobile joint (1) according to one of claims 1-6 and 7-8, the joint being mounted between a seat device (100) and a support (200) for said seat device (100).

* * * * *